US007652664B2

(12) United States Patent
Iwabuchi et al.

(10) Patent No.: US 7,652,664 B2
(45) Date of Patent: Jan. 26, 2010

(54) LIGHT EMITTING DEVICE

(75) Inventors: Tomoyuki Iwabuchi, Kanagawa (JP); Hiroyuki Miyake, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 411 days.

(21) Appl. No.: 10/596,680

(22) PCT Filed: Nov. 18, 2005

(86) PCT No.: PCT/JP2005/021624

§ 371 (c)(1),
(2), (4) Date: Jun. 21, 2006

(87) PCT Pub. No.: WO2006/057321

PCT Pub. Date: Jun. 1, 2006

(65) Prior Publication Data

US 2008/0100227 A1 May 1, 2008

(30) Foreign Application Priority Data

Nov. 24, 2004 (JP) ..... 2004-339684

(51) Int. Cl.
*G09G 5/00* (2006.01)

(52) U.S. Cl. ..... 345/212; 345/213; 345/80; 345/92; 345/76; 315/169.1; 315/169.3

(58) Field of Classification Search ... 315/169.1–169.3; 345/76, 77, 80, 89–92, 100, 204, 211–213; 330/51, 253
See application file for complete search history.

(56) References Cited

U.S. PATENT DOCUMENTS 6,710,548 B2 3/2004 Kimura
6,774,574 B1 8/2004 Koyama
6,777,887 B2 8/2004 Koyama
6,958,651 B2 * 10/2005 Kimura ..... 330/253
7,123,250 B2 * 10/2006 Kimura et al. ..... 345/211

(Continued)

FOREIGN PATENT DOCUMENTS

EP 1 231 592 A2 8/2002
JP 2001-005426 1/2001
JP 2002-311898 10/2002
JP 2005-122076 5/2005

OTHER PUBLICATIONS

International Search Report (Application No. PCT/JP2005/021624) dated Jan. 10, 2006.
Written Opinion of the International Searching Authority (Application No. PCT/JP2005/021624) dated Jan. 10, 2006.

*Primary Examiner*—Haissa Philogene
(74) *Attorney, Agent, or Firm*—Fish & Richardson P.C.

(57) ABSTRACT

Power consumption required for charging and discharging a source signal line is reduced in an active matrix EL display device. A bipolar transistor (Bi1) has a base terminal B connected to an output terminal c1 of an operational amplifier (OP1), a collector terminal C connected to a low power potential (GND), and an emitter terminal E connected to a resistor R2. A high power potential (VBH) is a potential in synchronization with a high power potential of a light emitting element. A potential of the output terminal c1 of the operational amplifier (OP1) is outputted as a buffer low power potential (VBL). The low power potential (VBL) corresponds to a potential difference between the high power potential (VBH) and a high power potential (V1). Accordingly, the low power potential (VBL) can follow the high power potential (VBH), that is a high power potential of the light emitting element.

31 Claims, 10 Drawing Sheets

U.S. PATENT DOCUMENTS 7,352,786 B2 * 4/2008 Ikeda ..... 372/38.01
2002/0105279 A1 8/2002 Kimura
2004/0207331 A1 10/2004 Koyama
2004/0263444 A1 12/2004 Kimura

* cited by examiner

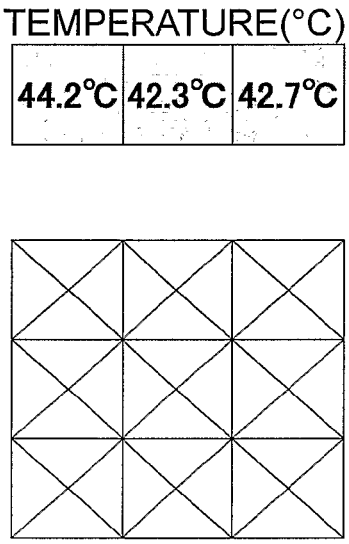
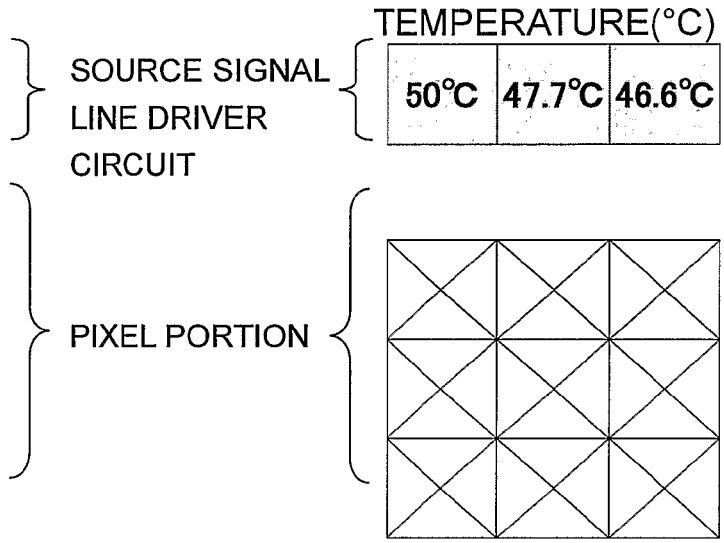
FIG. 8A
FIG. 8B
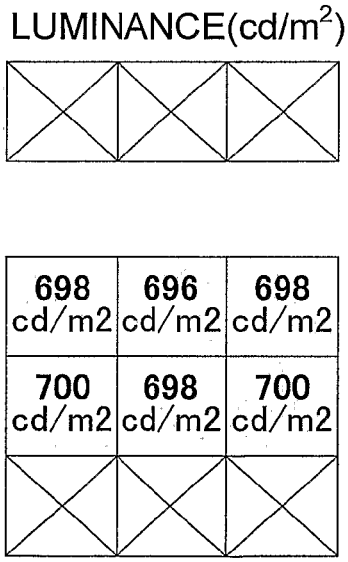
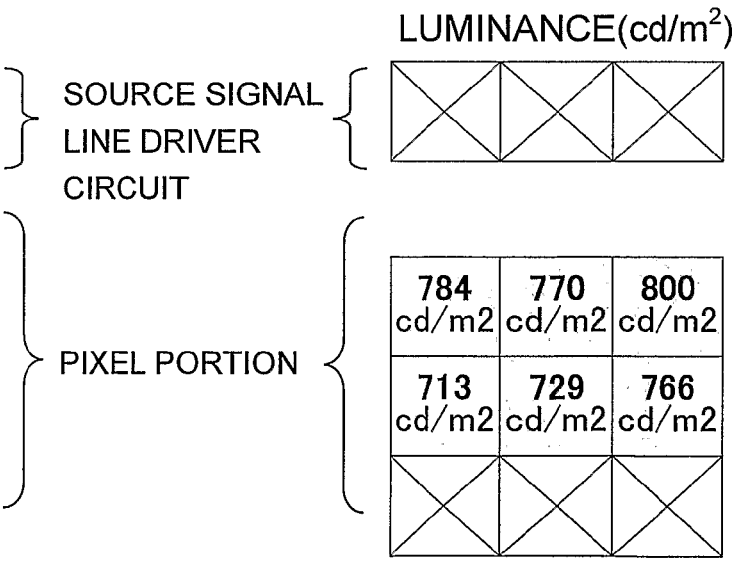
FIG. 8C
FIG. 8D

LIGHT EMITTING DEVICE

TECHNICAL FIELD

The invention relates to a light emitting device provided with a light emitting element.

BACKGROUND ART

Research on an active matrix light emitting device having a self-luminous element has been becoming more active. A typical example of such a self-luminous device is an EL display device.

In recent years, a flat panel display device which is widely used for a display portion of a portable information terminal as well as for a medium-size or a large-size display device has the increasing number of pixels in accordance with the high resolution. In accordance with the increase in the number of pixels, these displays employ pixels in an active matrix structure which has a thin film transistor (TFT) in each pixel and can store image data.

There are an analog gray scale method and a digital gray scale method in a gray scale method of an active matrix EL display device. The digital gray scale method has a time gray scale method, an area gray scale method, a method in which the time gray scale method and the area gray scale method are mixed, and the like. In either of the time gray scale method and the area gray scale method of the digital gray scale method, each pixel or subpixel is driven by binary values, namely an on state and an off state.

Accordingly, there is an advantage in that deterioration of image quality due to variations in a threshold voltage Vth of thin film transistors (TFTs) arranged in the pixel can be reduced as compared to the analog gray scale method. Patent Document 1 discloses a digital gray scale display performed by the time gray scale method.

Further, it is preferable for rapidly writing video signals to each of a plurality of pixels to employ a line sequential method in which data is inputted simultaneously per one row. Description is made with reference to FIG. 9 on an active matrix EL display device driven by the line sequential method to perform the digital gray scale display.

FIG. 9 shows a configuration of a display device driven by the digital gray scale method in which binary data is inputted to pixels in the active matrix structure. A pixel portion 501 includes a light emitting element typified by an EL element and a TFT for controlling light emission of the light emitting element. A source signal line driver circuit 502 including a shift register 504, a first latch circuit 505, a second latch circuit 506, a level shifter 507, and a buffer group circuit 508, and a gate signal line driver circuit 503 including a shift register 509, a level shifter 510, and a buffer group circuit 511 are arranged in the periphery of the pixel portion 501. FIGS. 10A and 10B show equivalent circuits of the buffer group circuit 508.

As shown in FIG. 10A, the buffer group circuit 508 includes a plurality of buffers 601 provided in each column. FIG. 10B shows an equivalent circuit of the buffer 601 which is formed of two inverters. An input of the buffer 601 is connected to the level shifter 507 and an output thereof is connected to the pixel portion 501. Further, a buffer high power potential (VBH) is applied from a signal line 602 and a low power potential (VBL) is applied from a signal line 603.

Description is made on a method for driving the active matrix display device shown in FIG. 9 by the line sequential method to perform a digital gray scale display. First, the shift register 509 outputs a selection pulse sequentially from a first stage in accordance with a clock signal (GCK) and a start pulse (GSP). After that, amplitude conversion is carried out by the level shifter 510, thereby gate lines are sequentially selected from the first row by the buffer group circuit 511.

In the selected row, the shift register 504 sequentially outputs sampling pulses from a first stage in accordance with a clock signal (SCK) and a start pulse. The first latch circuit 505 captures video signals (Video) at timing that sampling pulses are inputted. The video signals captured in each stage are held in the first latch circuit 505.

When a latch pulse (LAT) is inputted after video signals of one row are all captured, the video signals held in the first latch circuit 505 are transferred to the second latch circuit 506 all at once, thereby all source signals are charged and discharged.

At this time, the buffer high power potential (VBH) which charges and discharges the source signal line is in synchronization with a light emitting element high power potential (ANODE) while the low power potential (VBL) is fixed. In this specification, the light emitting element high power potential (ANODE) corresponds to a potential applied to an anode of the light emitting element.

The aforementioned operations are repeated from the first to the last rows, and thus data is written to all the pixels. Accordingly, an image corresponding to one frame is displayed. Similar operations are repeated to display images.

[Patent Document 1]

Japanese Patent Application Laid-Open no. 2001-5426

DISCLOSURE OF INVENTION

In the analog gray scale method, a gray scale display can be performed by writing data to the source signal line at least once in one frame.

On the contrary, in the digital gray scale method such as the time gray scale method in which each pixel is driven by binary values of the on state and the off state, the area gray scale method, and the method in which the time gray scale method and the area gray scale method are mixed, data is required to be written to the source signal line a plurality of times in one frame to display gray scales.

In an EL display device, a source signal line is a load for a buffer because of a plurality of TFTs provided in a pixel portion and parasitic capacitance. When data written to the source signal line changes from a Low potential to a High potential in the digital gray scale method, an external high potential power source which applies a high power potential (VBH) charges the load capacitance due to the source signal line from a Low potential to a High potential through a p-channel TFT of the buffer 601. On the other hand, when data written to the source signal line changes from a High potential to a Low potential, an external low potential power source which applies a low power potential (VBL) discharges the charges from the load capacitance due to the source signal line from a High potential to a Low potential through an n-channel TFT of the buffer 601.

These power are consumed when a voltage of the source signal line changes. Therefore, when an output of the source signal line often changes, power consumption of the external power source increases. Accordingly, in the digital gray scale method, power consumption of the external power source increases when displaying an image which requires a large number of gray scale levels such as a natural image and an image in which logic is frequently inversed per one row such as a 1-dot checker (here, light emission pixels and non-light emission pixels are alternately arranged in an active matrix structure), as a potential of the source signal line frequently changes.

Further, the current value to a light emitting element of a pixel portion also depends on a temperature. In particular, in the case of using an organic compound for a light emitting element, temperature characteristics are significant. Even when the same voltage is applied between electrodes of an EL element, more current flows through the EL element as the temperature rises because of the temperature characteristics of the EL element. Therefore, a display device consumes more power as the temperature of the EL element rises, which increases luminance of a light emitting element.

In the case of a color display, the light emitting element high power potential (ANODE) is set at different levels for each EL element depending on the light emitting material. In an EL element which emits red (R) light, an EL element which emits green (G) light, and an EL element which emits blue (B) light, the characteristics thereof changes differently due to deterioration over time and temperature.

In addition, for example, in the case where a user displays red frequently, only the EL element of R deteriorates prior to the other EL elements. Therefore, a display device which can manage various potential changes of the light emitting element high power potential (ANODE) is demanded.

A buffer high power potential (VBH) is required to be equal to or higher than the light emitting element high power potential (ANODE). The buffer high power potential (VBH) charges the source signal line, therefore, less power is required for the buffer high power potential (VBH) as the potential to be charged is lower. Therefore, the buffer high power potential (VBH) is preferably equal to the light emitting element high power potential (ANODE).

As described above, the light emitting element high power potential (ANODE) changes depending on a deterioration over time, a temperature change, a frequency of use, and the like. Accordingly, the buffer high power potential (VBH) is required to follow the light emitting element high power potential (ANODE) and to be in synchronization with the light emitting element high power potential (ANODE) in order to reduce the power required for charging at the desired light emitting element high power potential (ANODE).

Accordingly, the buffer high power potential (VBH) which charges and discharges the source signal line in a conventional display device is in synchronization with the light emitting element high power potential (ANODE) while the low power potential (VBL) is fixed.

As a result, a conventional buffer circuit tends to consume more power as described above, which easily rises the temperature of the buffer. In accordance with the generated heat of the buffer, a temperature distribution occurs in a pixel portion, leading to variations in luminance.

Alternatively, the light emitting element high power potential (ANODE) rises due to a deterioration over time and a temperature rise of an EL element, which results in increasing a potential difference to charge and discharge the source signal line, that is a difference between the high power potential (VBH) and the low power potential (VBL). Accordingly, the buffer 601 to charge and discharge the source signal line consumes more power and thus generates heat. As a result, variations in luminance of a pixel portion occur.

Accordingly, in the digital gray scale method, power consumption required for writing data to the source signal line is a serious issue in a compact display device for a portable terminal which is required to be low in power consumption. Further, it is hard to avoid the increase in parasitic capacitance of the source signal line in accordance with the increase in size of a display device such as a television, and the reduction in power consumption is a problem similarly to a compact display device.

The invention is made in view of the aforementioned problems so that a circuit using an inverter, such as a buffer consumes less power. Further, the invention is made to reduce power consumption required for charging and discharging the source signal line of an active matrix display device using a light emitting element.

According to the invention, a low power potential (VBL) of a buffer (inverter) which charges and discharges a source signal line follows a high power potential (VBH) thereof. In a light emitting device, in particular, the low power potential (VBL) follows a light emitting element high power potential (ANODE).

A light emitting device in accordance with the invention includes a light emitting element, a bipolar transistor, an operational amplifier, and first to fourth resistors. In the bipolar transistor, a base terminal is connected to an output terminal of the operational amplifier and a collector terminal is connected to a low power potential. The first resistor has one terminal connected to a first high power potential and the other terminal connected to a first input terminal of the operational amplifier. The second resistor has one terminal connected to a first input terminal of the operational amplifier and the other terminal connected to an emitter terminal of the bipolar transistor. The third resistor has one terminal connected to a second high power potential and the other terminal connected to a second input terminal of the operational amplifier. The fourth resistor has one terminal connected to a second input terminal of the operational amplifier and the other terminal connected to the low power potential. The potentials at the emitter terminal of the bipolar transistor and at the other terminal of the second resistor are supplied as a low power potential of a buffer of a driver circuit. The second high power potential is supplied as a high power potential of the buffer.

A light emitting device in accordance with the invention includes a light emitting element, an operational amplifier, and first to fourth resistors. The first resistor has one terminal connected to a first high power potential and the other terminal connected to a first input terminal of the operational amplifier. The second resistor has one terminal connected to the first input terminal of the operational amplifier and the other terminal connected to an output terminal of the operational amplifier. The third resistor has one terminal connected to a second high power potential and the other terminal connected to a second input terminal of the operational amplifier. The fourth resistor has one terminal connected to the second input terminal of the operational amplifier and the other terminal connected to a low power potential. A potential at the other terminal of the second resistor is supplied as a low power potential of a buffer and the second high power potential is supplied as a high power potential of the buffer.

According to the invention, a light emitting element of a light emitting device is arranged in a pixel. As the light emitting element, an EL element is used. An EL element has a structure in which a pair of electrodes (an anode and a cathode) sandwich a layer (hereinafter referred to as an EL layer) which generates electroluminescence when an electric field is applied thereto. An EL layer is formed of an organic compound and normally has a stacked-layer structure. Typically, a stacked-layer structure of a hole transporting layer, a light emitting layer, and an electron transporting layer is suggested.

Further, luminescence of the EL layer includes light emission (fluorescence) generated when returning from a singlet excitation state to a ground state, and light emission (phosphorescence) generated when returning from a triplet excitation state to a ground state. A light emitting device of the invention may employ one or both of the aforementioned light emission.

Besides, a structure in which a hole injecting layer, a hole transporting layer, a light emitting layer, and an electron transporting layer are stacked over an anode in this order or a structure in which a hole injecting layer, a hole transporting layer, a light emitting layer, an electron transporting layer, and an electron injecting layer are stacked over an anode in this order may be employed as well. A phosphorescent pigment and the like may be added to the light emitting layer.

In this specification, all layers provided between a cathode and an anode are collectively referred to as an EL layer. Therefore, a hole injecting layer, a hole transporting layer, a light emitting layer, an electron transporting layer, an electron injecting layer and the like that are described above are all included in the EL layer.

According to the invention, when a high power potential (VBH or ANODE) rises, a low power potential of a buffer rises by following the high power potential. Therefore, a rise in a potential difference between the high power potential and the low power potential supplied to the buffer (inverter) can be suppressed. As a result, data of the source signal line can be rewritten by less power. Accordingly, heat generated by the buffer can be suppressed, which can reduce variations in luminance of the pixel portion caused by the generated heat.

Accordingly, the invention is quite favorable for a light emitting device such as an EL display device which performs digital gray scale drive by the line sequential method.

BRIEF DESCRIPTION OF DRAWINGS

FIGS. 8A to 8D show temperature distribution of a source signal line driver circuit and luminance distribution of a pixel portion in Embodiment Mode 1 and a comparison example respectively.

BEST MODE FOR CARRYING OUT THE INVENTION

Figure 1:
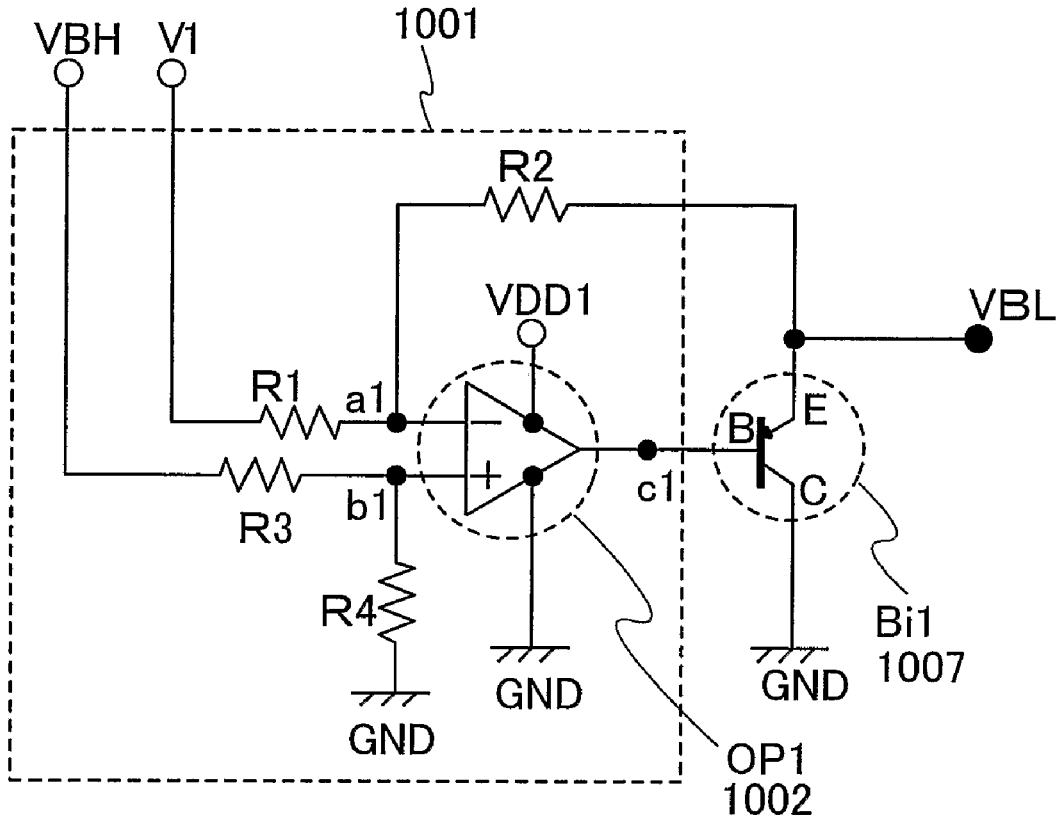
FIG. 1 is a diagram showing Embodiment Mode 1.

Although the invention will be fully described by way of embodiment modes and embodiment with reference to the accompanying drawings, it is to be understood that various changes and modifications will be apparent to those skilled in the art. Therefore, unless otherwise such changes and modifications depart from the scope of the invention, they should be construed as being included therein. Note that identical portions in embodiment modes are denoted by the same reference numerals and detailed descriptions thereof are omitted.

EMBODIMENT MODE 1

This embodiment mode is described with reference to FIGS. 1, 2A, and 2B.

FIG. 1 is a circuit diagram of a potential generating circuit of this embodiment mode. As shown in FIG. 1, the potential generating circuit includes resistors R1 to R4, an operational amplifier (OP1) 1002, and a bipolar transistor (Bi1) 1007.

Two power source connecting terminals of the operational amplifier OP1 are inputted with a high power potential (VDD1) and a low power potential (GND) respectively. Further, an output terminal c1 of the operational amplifier (OP1) is connected to a base terminal B of the bipolar transistor (Bi1). The base terminal B of the bipolar transistor (Bi1) is connected to the output terminal c1 of the operational amplifier (OP1) and a collector terminal C thereof is connected to the low power potential (GND).

The resistor R1 has one terminal connected to a high power potential (V1) and the other terminal connected to an input terminal al of the operational amplifier (OP1). The resistor R2 has one terminal connected to the input terminal al of the operational amplifier (OP1) and the other terminal connected to an emitter terminal E of the bipolar transistor (Bi1). The resistor R3 has one terminal connected to a high power potential (VBH) and the other terminal connected to an input terminal b1 of the operational amplifier (OP1). The resistor R4 has one terminal connected to the input terminal b1 of the operational amplifier (OP1) and the other terminal connected to the low power potential (GND). Potentials at the emitter terminal E of the bipolar transistor (Bi1) and the other terminal of the resistor R2 are outputted as a low power potential (VBL). The low power potential (VBL) corresponds to a difference between the high power potential (VBH) and the high power potential (V1).

Figure 2A:
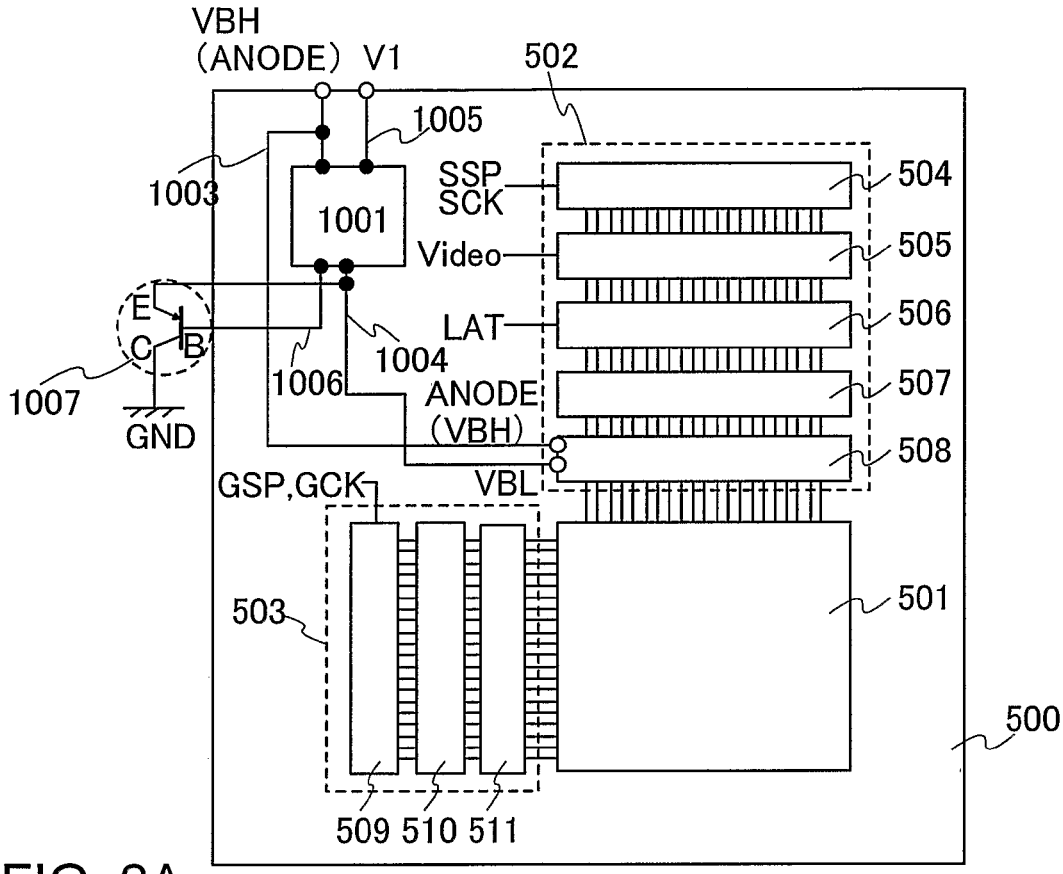
FIGS. 2A and 2B are diagrams showing Embodiment Mode 1.
Figure 9:
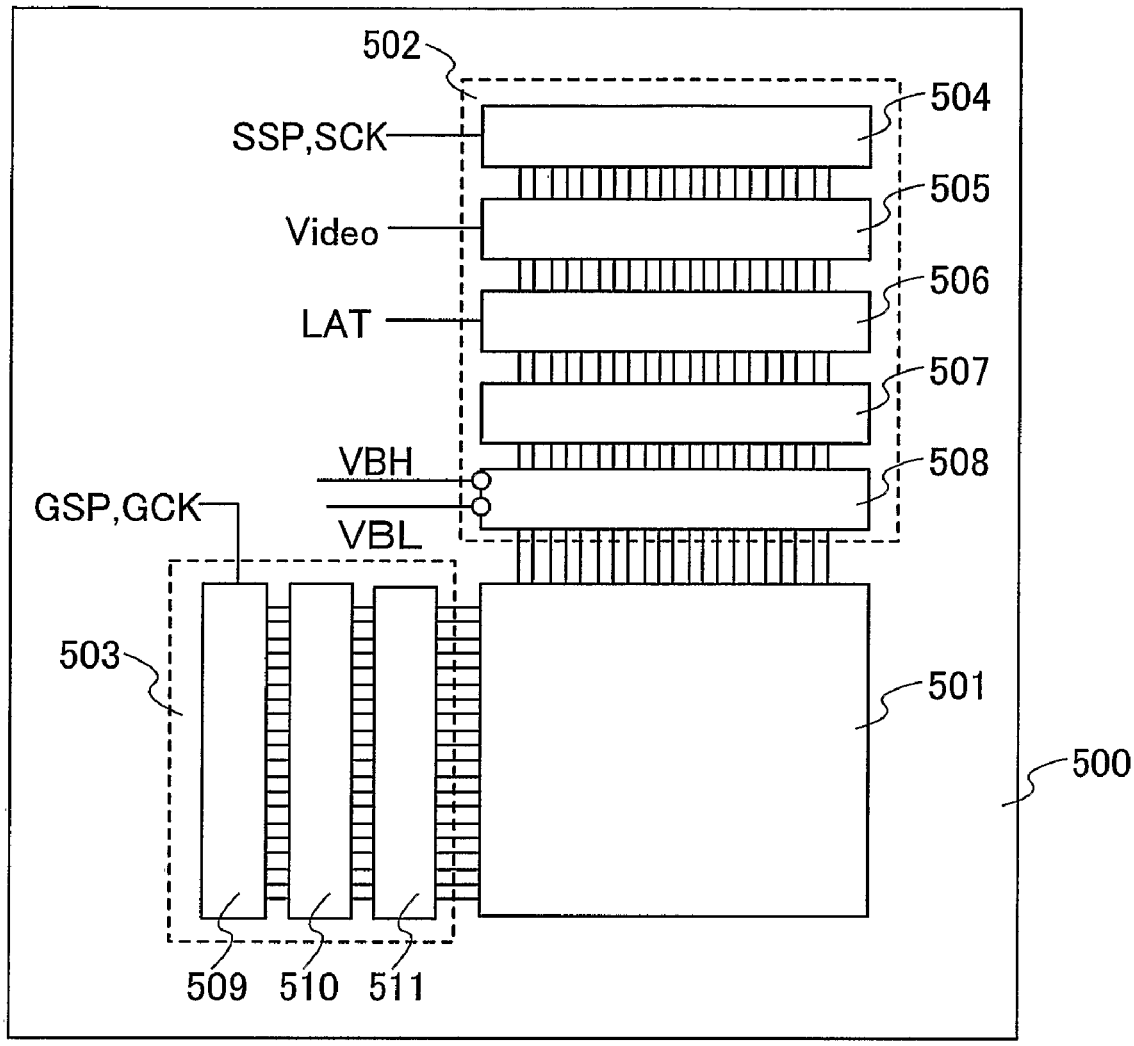
FIG. 9 shows an EL display device of a digital gray scale method.

FIG. 2A shows a light emitting device using the circuit shown in FIG. 1. In FIG. 2A, the same reference numerals as those in FIG. 9 denote the same components.

In FIG. 2A, a pixel portion 501 is provided with a light emitting element, which is typically an EL element, and a TFT for controlling light emission of the light emitting element, thereby forming pixels in an active matrix structure. A source signal line driver circuit 502 and a gate signal line driver circuit 503 formed by using TFTs are arranged in the periphery of the pixel portion 501 over the same substrate 500 as the pixel portion 501.

The source signal line driver circuit 502 includes a shift register 504, a first latch circuit 505, a second latch circuit 506, a level shifter 507, and a buffer group circuit 508. The gate signal line driver circuit 503 includes a shift register 509, a level shifter 510, and a buffer group circuit 511.

Figure 10A:
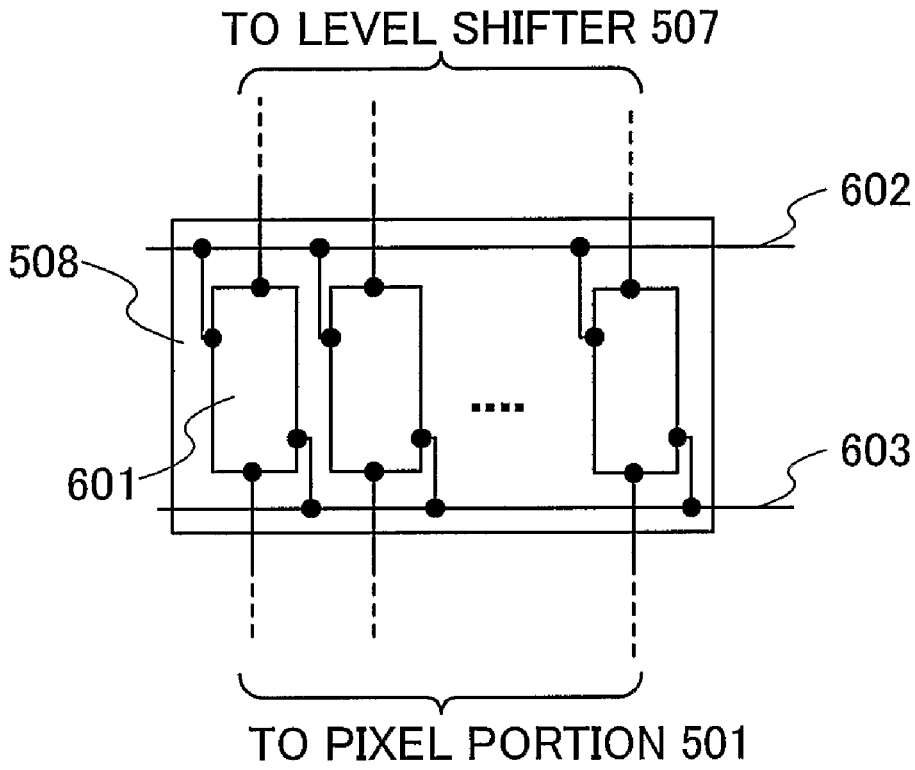
FIGS. 10A and 10B show equivalent circuits of a buffer.
Figure 10B:
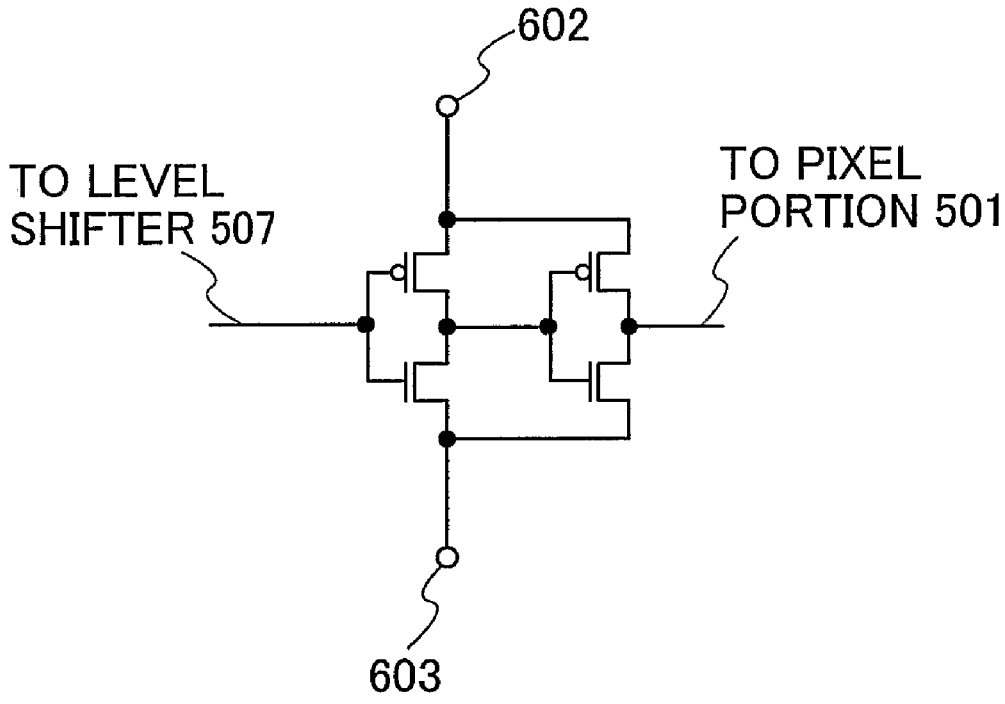

In FIG. 2A also, buffers 601 are arranged per column in the buffer group circuit 508 as shown in FIG. 10A. FIG. 10B shows an equivalent circuit of the buffer 601. The buffer group circuit 508 is connected to a signal line (a power source line) 1003 for supplying a buffer high power potential (VBH) and a signal line (a power source line) 1004 for supplying a buffer low power potential (VBL). Further, the signal line 1003 is connected to the signal line 602 which supplies the buffer high power potential (VBH) of the buffer group circuit 508. The signal line 1004 is connected to a signal line 603 which supplies the buffer low power potential (VBL) (see FIG. 10B). As a result, the buffer high power potential (VBH)

is supplied from the signal line 1003 to the buffer group circuit 508, and the low power potential (VBL) is supplied from the signal line 1004.

Further, a power supply line for supplying power to an anode of the light emitting element is provided. The power supply line is connected to an external power source which applies the buffer high power potential (VBH). Therefore, the buffer high power potential (VBH) is equal to the light emitting element high power potential (ANODE). It is to be noted that the high power potential (VBH) of the buffer and the light emitting element high power potential (ANODE) may be at the same level or different external power sources may be provided. Sharing the power source leads to the reduction in power and the number of connecting portions.

In this embodiment mode, the potential generating circuit shown in FIG. 1 is connected to the signal line 1004. The potential generating circuit includes, a circuit 1001 formed of the resistors R1 to R4 and an operational amplifier (OP1) 1002, and a bipolar transistor (Bi1) 1007. In the light emitting device of this embodiment mode, the pixel portion 501, the source signal line driver circuit 502, and the gate signal line driver circuit 503 are formed by using TFTs over the same substrate 500 except for the bipolar transistor (Bi1) 1007. The bipolar transistor (Bi1) 1007 is formed by using an IC chip and mounted over the substrate 500, for example, by a COG method.

Figure 2B:
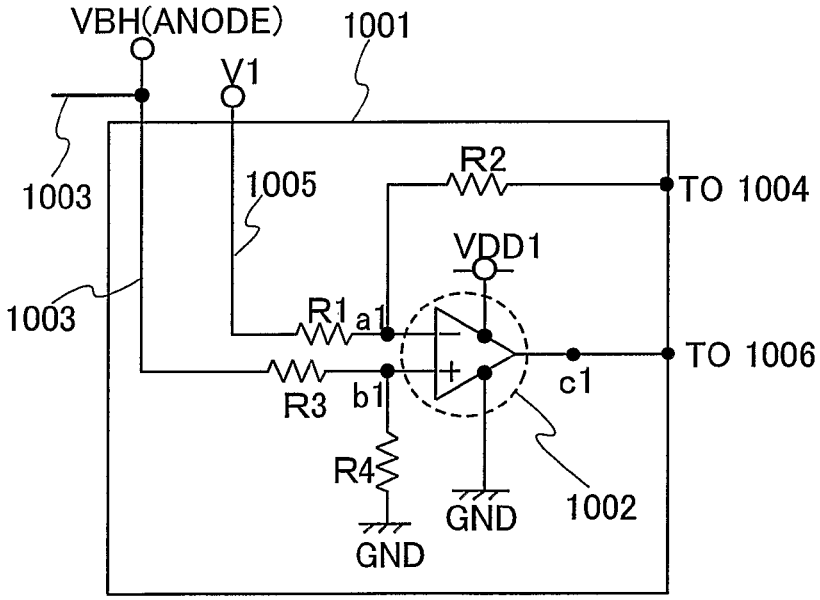

FIG. 2B shows a circuit diagram of the circuit 1001. Two power source connecting terminals of the operational amplifier (OP1) 1002 are inputted with the high power potential (VDD1) and the low power potential (GND) respectively. Further, the base terminal B of the bipolar transistor (Bi1) 1007 is connected to the output terminal cl of the operational amplifier (OP1) 1002.

A base terminal B of the bipolar transistor (Bi1) 1007 is connected to the output terminal c1 of the operational amplifier (OP1) 1002, a collector terminal C thereof is connected to the low power potential (GND), and an emitter terminal E thereof is connected to the resistor R2 and the signal line 1004 which supplies the low power potential (VBL).

The resistor R1 has one terminal connected to a signal line (a power source line) 1005 which supplies the high power potential (V1) and the other terminal connected to the input terminal al of the operational amplifier (OP1) 1002. The resistor R2 has one terminal connected to the input terminal al of the operational amplifier (OP1) 1002 and the other terminal connected to the emitter terminal E of the bipolar transistor (Bi1) 1007. The resistor R3 has one terminal connected to the high power potential (VBH) of the buffer and the signal line 1003 which supplies the light emitting element high power potential (ANODE) and the other terminal thereof connected to the input terminal b1 of the operational amplifier (OP1) 1002. The resistor R4 has one terminal connected to the input terminal b1 of the operational amplifier (OP1) 1002 and the other terminal connected to the low power potential (GND).

The high power potential (V1) is at a lower level than the buffer high power potential (VBH) and the light emitting element high power potential (ANODE). In this embodiment mode, the buffer high power potential (VBH) and the light emitting element high power potential (ANODE) are at the same level, however, the buffer high power potential (VBH) may be at a higher level. In this case, different external power sources are used for the light emitting element high power potential (ANODE) and the buffer high power potential (VBH).

In this embodiment mode, an amplifier ratio of the operational amplifier (OP1) 1002 is 1 and resistance of the resistors R1 to R4 are all equal. It is needless to say that the resistance of the resistors R1 to R4 may be changed as required so as to set the buffer high power source potential (VBH), the light emitting element high power potential (ANODE), the buffer low power potential (VBL), and the high power potential (V1) at the required levels. Further, the operational amplifier (OP1) 1002 is preferably designed to consume less power.

By using the potential generating circuit formed of the operational amplifier (OP1) 1002 of this embodiment mode, the buffer low power potential (VBL) becomes a potential obtained by subtracting the high power potential (V1) from the light emitting element high power potential (ANODE).

Accordingly, the buffer low power potential (VBL) rises by following the light emitting element high power potential (ANODE), thereby an increase in power consumption of the buffer can be suppressed.

In the potential generating circuit of this embodiment mode, the circuit 1001 except for the bipolar transistor (Bi1) is formed over the same substrate as the pixel portion 501, the source signal line driver circuit 502, and the gate signal line driver circuit 503, thereby the number of external components can be reduced. The potential generating circuit shown in FIG. 1 may be all formed of ICs which then may be mounted over the substrate 500, for example, by the COG method and the like.

In this embodiment mode, the source signal line driver circuit 502 and the gate signal line driver circuit 503 as well as the pixel portion 501 are formed by using TFTs, however, a portion or all of each circuit may be formed of an IC and then mounted by the COG method or a TAB method.

EMBODIMENT MODE 2

Figure 3:
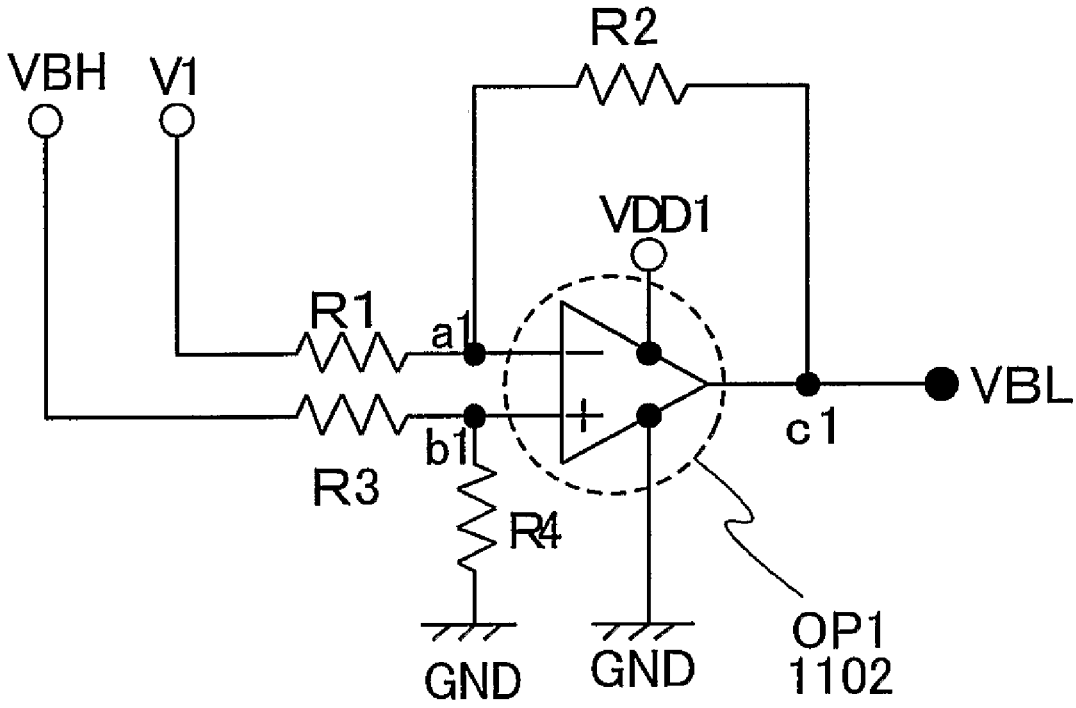
FIG. 3 is a diagram showing Embodiment Mode 2.

FIG. 3 is a circuit diagram of a potential generating circuit of this embodiment mode. As shown in FIG. 3, the potential generating circuit includes the resistors R1 to R4 and the operational amplifier (OP1).

Two power source connecting terminals of the operational amplifier (OP1) are inputted with the high power potential (VDD1) and the low power potential (GND) respectively.

The resistor R1 has one terminal connected to the high power potential (V1) and the other terminal connected to an input terminal al of an operational amplifier (OP1) 1102. The resistor R2 has one terminal connected to the input terminal a1 of the operational amplifier (OP1) 1102 and the other terminal connected to an output terminal c1 of the operational amplifier (OP1) 1102. The resistor R3 has one terminal connected to a high power potential (VBH) and the other terminal connected to an input terminal b1 of the operational amplifier (OP1) 1102. The resistor R4 has one terminal connected to the input terminal b1 of the operational amplifier (OP1) 1102 and the other terminal connected to the low power potential (GND). A potential of the output terminal c1 of the operational amplifier (OP1) 1102 is outputted as the low power potential (VBL). The low power potential (VBL) corresponds to a difference between the high power potential (VBH) and the high power potential (V1).

Figure 4A:
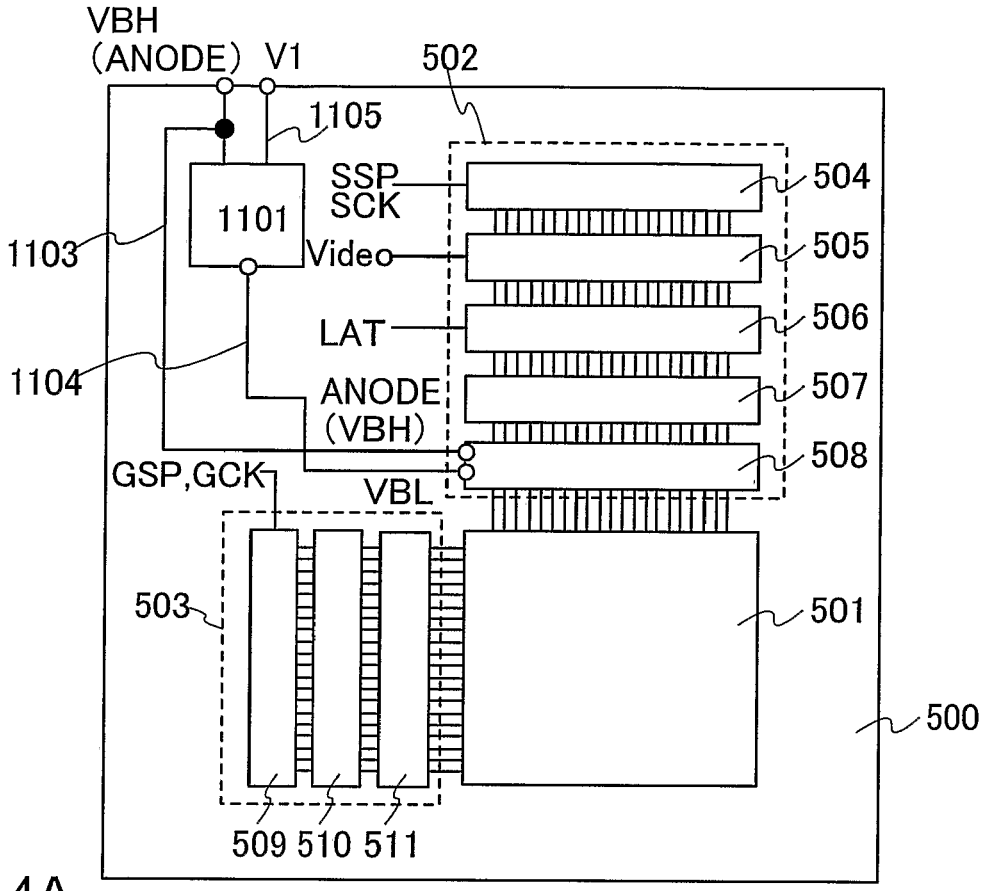
FIGS. 4A and 4B are diagrams showing Embodiment Mode 2.
Figure 4B:
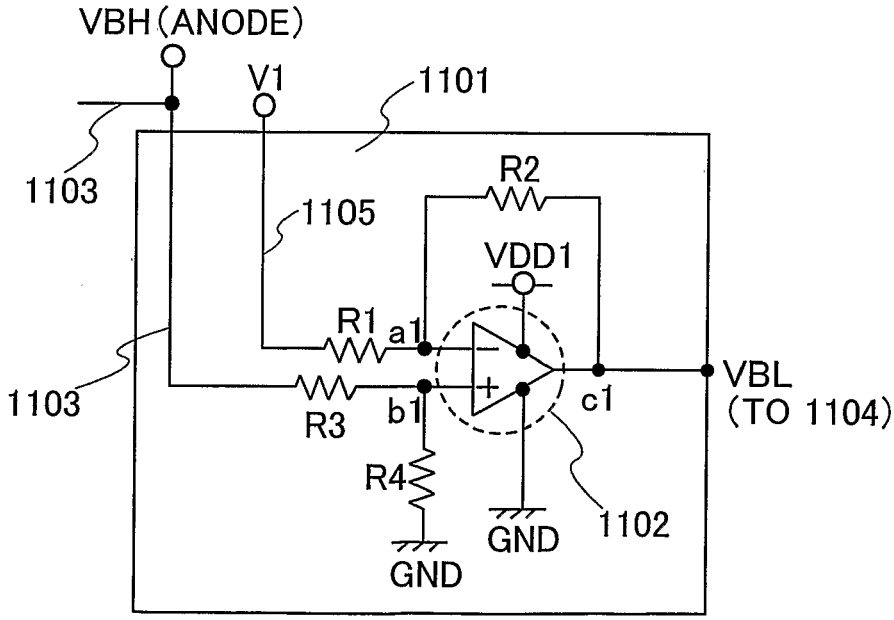

FIG. 4A shows a light emitting device using the potential generating circuit shown in FIG. 3. In FIGS. 4A and 4B, the same reference numerals as those in FIGS. 9, 2A, and 2B denote the same components. Further, the light emitting device of this embodiment mode is similar to FIGS. 2A and 2B of Embodiment Mode 1 except for a potential generating circuit 1101.

The potential generating circuit 1101 of this embodiment mode, is formed by using TFTs over the same substrate 500 as the pixel portion 501, the source signal line driver circuit 502, and the gate signal line driver circuit 503.

In the potential generating circuit 1101 as shown in FIG. 4B, two power source connecting terminals of the operational amplifier (OP1) 1102 are connected to the high power potential (VDD1) and the low power potential (GND) respectively. The output terminal c1 of the operational amplifier (OP1) 1102 is connected to the one terminal of the resistor R2 and the signal line (the power source line) 1104 which supplies the low power potential (VBL) to the buffer group circuit 508.

The resistor R1 has one terminal connected to the signal line (the power source line) 1105 which supplies the high power potential (V1) and the other terminal connected to the input terminal al of the operational amplifier (OP1) 1102. The resistor R2 has one terminal connected to the input terminal al of the operational amplifier (OP1) 1102 and the other terminal connected to the output terminal c1 of the operational amplifier (OP1) 1102. The resistor R3 has one terminal connected to the signal line (the power source line) 1103 which supplies the high power potential (VBH) of the buffer and the light emitting element high power potential (ANODE) and the other terminal connected to the input terminal b1 of the operational amplifier (OP1) 1102. The resistor R4 has one terminal connected to the input terminal b1 of the operational amplifier (OP1) 1102 and the other terminal connected to the low power potential (GND).

Here, an amplifier ratio of the operational amplifier (OP1) 1102 is 1 and resistance of the resistors R1 to R4 are all equal. It is needless to say that the resistance of the resistors Ri to R4 may be changed as required so as to set the buffer high power source potential (VBH), the light emitting element high power potential (ANODE), the buffer low power potential (VBL), and the high power potential (V1) at the required levels. Further, the operational amplifier (OP1) 1102 is preferably designed to consume less power.

The buffer group circuit 508 is connected to the signal lines 1103 and 1104. The signal line 1103 is connected to the signal line 602 which supplies the buffer high power potential (VBH) of the buffer group circuit 508 and the signal line 1104 is connected to the signal line 603 which supplies the buffer low power potential (VBL) (see FIG. 10B ). As a result, the buffer high power potential (VBH) is supplied from the signal line 1103 and the buffer low power potential (VBL) is supplied from the signal line 1104.

In the pixel portion 501, a power supply line for supplying power to an anode of the light emitting element is provided. The power supply line is connected to an external power source which applies the buffer high power potential (VBH). Therefore, the buffer high power potential (VBH) is equal to the light emitting element high power potential (ANODE) in this embodiment mode. It is to be noted that the high power potential (VBH) of the buffer and the light emitting element high power potential (ANODE) may be at the same level or different external power sources may be provided. Sharing the power source leads to the reduction in power and the number of connecting portions.

The high power potential (V1) is at a lower level than the buffer high power potential (VBH) and the light emitting element high power potential (ANODE). Further, the buffer high power potential (VBH) here is at the same level as the light emitting element high power potential (ANODE), however, the buffer high power potential (VBH) may be at a higher level than the light emitting element high power potential (ANODE).

By the potential generating circuit 1101, the buffer low power potential (VBL) becomes a potential obtained by subtracting the high power potential (V1) from the light emitting element high power potential (ANODE). Accordingly, even when the light emitting element high power potential (ANODE) rises, the buffer low power potential (VBL) can rise by following the light emitting element high power potential (ANODE).

In this embodiment mode, by forming the potential generating circuit 1101 over the same substrate 500 as the pixel portion 501, the source signal line driver circuit 502, and the gate signal line driver circuit 503, the number of external components can be reduced. It is needless to say that the potential generating circuit 1101 may be all formed of an IC and then mounted over the substrate 500, for example, by the COG method and the like.

In this embodiment mode, the source signal line driver circuit 502 and the gate signal line driver circuit 503 as well as the pixel portion 501 are formed by using TFTs, however, a portion or all of each circuit may be formed of an IC and then mounted by the COG method or the TAB method.

In Embodiment Modes 1 and 2, in the case of providing in the pixel portion 501 a plurality of kinds of light emitting elements formed of different EL materials, such as an EL element which emits red (R) light, an EL element which emits green (G) light, and an EL element which emits blue (B) light, it is preferable to set the light emitting element high power potentials (ANODE) depending on the kinds of the light emitting elements such as R, G, and B. Therefore, it is preferable to provide the light emitting element high power potential (ANODE) and the buffer low power potential (VBL) depending on the kinds of the light emitting elements.

EMBODIMENT MODE 3

As described in Embodiment Modes 1 and 2, the invention is preferably applied to an electronic device which is required to have a high resolution display portion as the invention can suppress power consumption of an EL display device and variations in luminance of the display portion caused by the high resolution of the pixels. Examples are a television device (a television, a television receiver), a camera such as a digital camera, and a digital video camera, a portable phone device (a portable phone), a portable information terminal such as a PDA, a portable game machine, a monitor, a computer, an audio reproducing device such as a car audio set, and an image reproducing device provided with a recording medium such as a home game machine. Specific examples of these are described with reference to FIGS. 11A to 11F.

Figure 11A:
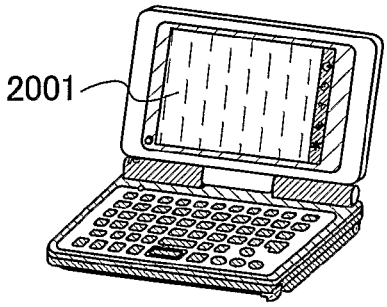
FIGS. 11A to 11F are views showing electronic devices.
Figure 11B:
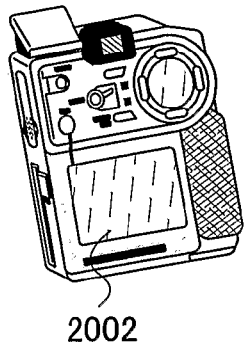
Figure 11C:
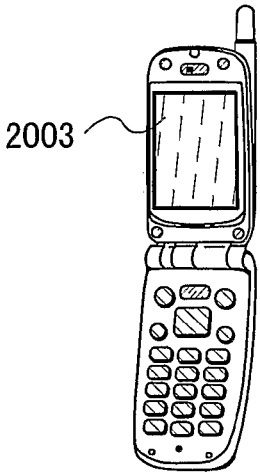
Figure 11D:
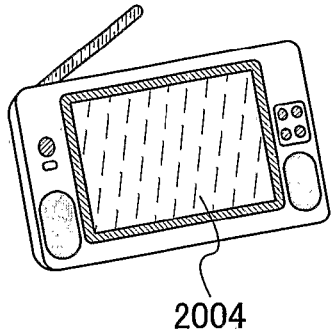
Figure 11E:
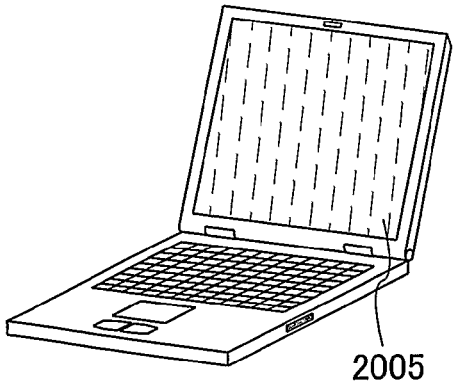
Figure 11F:
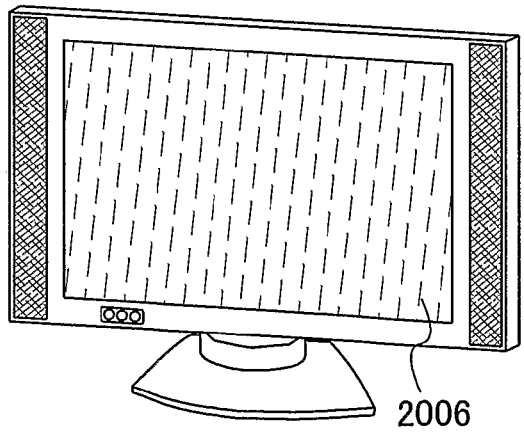

For example, the invention can be applied to a portable information terminal shown in FIG. 11A, a digital video camera shown in FIG. 11B, a portable phone shown in FIG. 11C, a portable television device shown in FIG. 11D, a notebook computer shown in FIG. 11E, and a television device shown in FIG. 11F. The invention can be used for display portions 2001 to 2006 in each of the devices.

According to the invention, life of each of the devices shown in FIGS. 11A to 11E with batteries can be prolonged as the power consumption is reduced.

In a large display portion such as the television device shown in FIG. 11F also, heat generation of the source signal line driver circuit can be suppressed, thereby variations in luminance caused by the generated heat do not easily occur even when used for a long time.

EMBODIMENT

Embodiment 1

Figure 5:
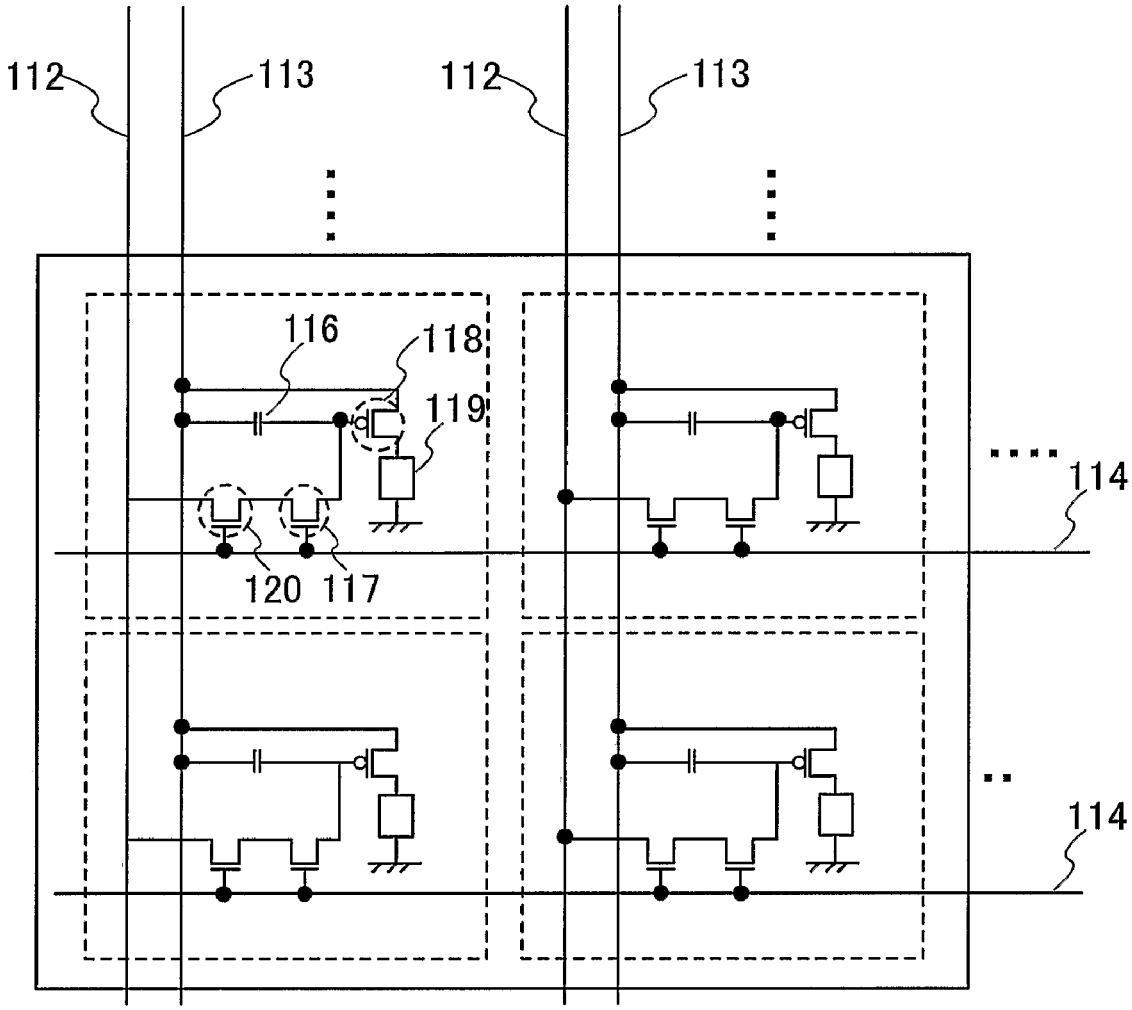
FIG. 5 is a diagram showing a pixel portion of Embodiment 1.

In Embodiment 1, an example of manufacturing the light emitting device of Embodiment Mode 1 shown in FIGS. 2A and 2B is described. This embodiment is different than Embodiment Mode 1 in that the circuit in FIG. 1 employs an IC. FIG. 5 shows an equivalent circuit configuration of a pixel portion of this embodiment. A pixel configuration of this embodiment is not limited to the circuit shown in FIG. 5.

As shown in FIG. 5, a source signal line 112 is connected to a source terminal of an n-channel TFT 120 of which drain terminal is connected to a source terminal of an n-channel TFT 117. Gate terminals of the n-channel TFT 120 and the n-channel TFT 117 are connected to a gate signal line 114. The n-channel TFT 120 and the n-channel TFT 117 are shown as two TFTs connected in series. However, the two n-channel TFTs 117 and 120 are manufactured as one double gate TFT which shares a semiconductor layer provided with a channel.

A pixel capacitor Cp 116 has one terminal connected to a signal line (a power source line) 113 which applies the light emitting element high power potential (ANODE) and the other terminal connected to a drain terminal of the n-channel TFT 117 and a gate terminal of a p-channel TFT 118.

The p-channel TFT 118 has a source terminal connected to the signal line 113 which applies the light emitting element high power potential (ANODE) and a drain terminal connected to an anode of a light emitting element 119.

The light emitting element 119 is formed of an EL element of which anode is connected to the drain terminal of the p-channel TFT 118 and of which cathode is connected to a light emitting element low power potential (CATHODE).

Figure 6:
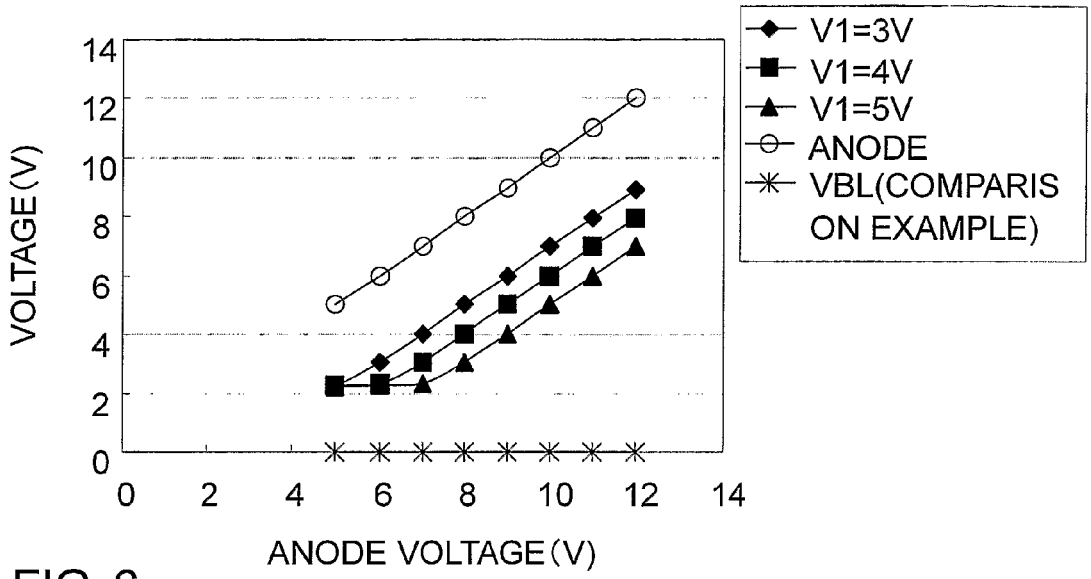
FIG. 6 shows a buffer low power potential (VBL) in accordance with a light emitting element high power potential (ANODE).
Figure 7:
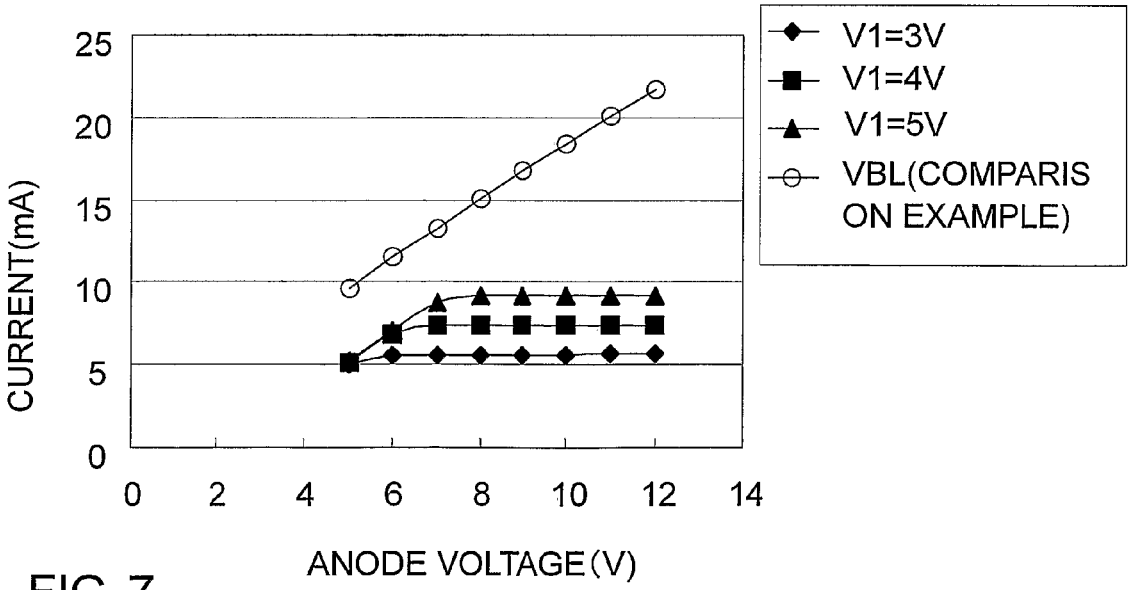
FIG. 7 shows a current flowing through a signal line which supplies a buffer low power potential (VBL) in accordance with a light emitting element high power potential (ANODE).

FIGS. 6 and 7 show measurement results showing the effects of this embodiment. Both of FIGS. 6 and 7 show data in the case where the buffer high power potential (VBH) is in synchronization with the light emitting element high power potential (ANODE) so as to be at the same level.

FIG. 6 shows a change of the buffer low power potential (VBL) in accordance with a change of the light emitting element high power potential (ANODE). FIG. 7 shows a change of a current flowing through the signal line 1004 which supplies the buffer low power potential (VBL) in accordance with a change of the light emitting element high power potential (ANODE). By setting the high power potential (VDD1) of the operational amplifier (OP1) at 15 V and the low power potential (GND) thereof at 0 V, the light emitting element high power potential (ANODE) is changed from 5 to 12 V. The high power potential (V1) is set at 3, 4, and 5 V, thereby a light emitting device is driven in the digital gray scale by the line sequential method.

In FIG. 6, data of the buffer low power potential (VBL) fixed at 0 V corresponds to data of a light emitting device of a comparison example which is not provided with the circuit shown in FIG. 1. The same can be applied to the comparison examples in FIGS. 7, and 8B, and 8D.

As shown in FIG. 6, in a conventional configuration, the buffer low power potential (VBL) is fixed at 0 V. Therefore, a potential difference between the high power potential (VBH) and the low power potential (VBL), which are supplied to an inverter of the buffer is increased when the light emitting element high power potential (ANODE) rises.

In this embodiment, on the other hand, the buffer low power potential (VBL) rises by following the rise of the light emitting element high power potential (ANODE), thereby a potential difference between the high power potential (VBH) and the low power potential (VBL) is decreased as compared to the comparison example as shown in FIG. 6.

It is found in FIG. 7 that a current value is in proportion to the light emitting element high power potential (ANODE) in the case where the buffer low power potential (VBL) is fixed in the display device of the comparison example, and that the current value is increased as the light emitting element high power potential (ANODE) rises.

In this embodiment, on the other hand, the current value is not in proportion to the rise of the light emitting element high power potential (ANODE). In the case where the light emitting element high power potential (ANODE) is 7 V or higher, the current value is about 5.6 mA when the buffer low power potential (VBL) is 3 V, about 7 mA when the buffer low power potential is 4 V, and about 9 mA when the buffer low power potential is 5 V, and thus the current values can be seen to be almost constant.

That is, in accordance with this embodiment, rise in power consumption can be suppressed even when the light emitting element high power potential (ANODE) rises depending on a change over time and a temperature. Further, heat generation of the source signal line circuit can be suppressed.

A temperature of a source signal line driver circuit and luminance of a pixel portion of a light emitting device are measured after one hour of driving in order to further check the effects of this embodiment. FIGS. 8A and 8B show temperatures of the source signal line of this embodiment and the comparison example respectively. FIGS. 8C and 8D show luminance of the light emitting element of this embodiment and the comparison example respectively. The light emitting device of this embodiment is driven by fixing the light emitting element high power potential (ANODE) at 10 V and the high power potential (V1) at 4 V respectively. The light emitting device of the comparison example is measured by fixing the light emitting element high power potential (ANODE) at 10 V.

As shown in FIGS. 8A and 8B, the temperature of the source signal line driver circuit is lower in the light emitting device of this embodiment than the comparison example. This embodiment of (A) has an average temperature lower than the comparison example (B) by about 5° C. The deterioration in luminance caused by an environment temperature is affected by the change of 2 to 3° C., therefore, the fall of 5° C. of this invention is considered a large effect. That is, heat generation is suppressed and variations in luminance caused by the generated heat can be suppressed by this embodiment.

In the embodiment shown in FIG. 8C, heat generation of the source signal line driver circuit is suppressed, therefore, luminance is almost equal in the periphery of the source signal line driver circuit and the periphery of the center of the pixel portion. However, in FIG. 8D, the luminance of a portion on the source signal line driver circuit side is increased by the generated heat of the source signal line driver circuit, and thus variations in luminance are caused. That is, variations in luminance of the pixel portion caused by the generated heat are suppressed by this embodiment.

In this embodiment, an effect of the circuit of Embodiment Mode 1 is verified. It is easily estimated by the aforementioned experiment results that a similar effect can be obtained by the circuit of Embodiment Mode 2.

This application is based on Japanese Patent Application serial no. 2004-339684 filed in Japan Patent Office on 24 Nov. 2004, the entire contents of which are hereby incorporated by reference.

The invention claimed is:

1. A light emitting device comprising:

a light emitting element, a bipolar transistor, an operational amplifier, a driver circuit, a first resistor, a second resistor, a third resistor, and a fourth resistor, wherein the bipolar transistor has a base terminal connected to an output terminal of the operational amplifier and a collector terminal connected to a low power potential, wherein the first resistor has one terminal connected to a first high power potential and the other terminal connected to a first input terminal of the operational amplifier, wherein the second resistor has one terminal connected to the first input terminal of the operational amplifier and the other terminal connected to the emitter terminal of the bipolar transistor, wherein the third resistor has one terminal connected to a second high power potential and the other terminal connected to a second input terminal of the operational amplifier, wherein the fourth resistor has one terminal connected to a second input terminal of the operational amplifier and the other terminal connected to a low power potential, wherein a potential from the emitter terminal of the bipolar transistor and the other terminal of the second resistor is supplied as a low power potential of a buffer of the driver circuit, and wherein the second high power potential is supplied as a high power potential of the buffer.

2. The light emitting device according to claim 1, wherein the light emitting element is an EL element.

3. The light emitting device according to claim 1, wherein the light emitting device is provided over a semiconductor substrate.

4. The light emitting device according to claim 1, wherein the light emitting device is provided over a glass substrate.

5. The light emitting device according to claim 1, wherein the light emitting device is provided over a flexible substrate.

6. The light emitting device according to claim 1, wherein the light emitting device is provided over an SOI substrate.

7. The light emitting device according to claim 1, wherein the light emitting device includes a thin film transistor.

8. An IC card, an IC tag, an RFID, a transponder, paper money, securities, a passport, an electronic device, a bag, clothes each of which includes the light emitting device according to claim 1.

9. A light emitting device comprising:

a light emitting element, an operational amplifier, a driver circuit, a first resistor, a second resistor, a third resistor, and a fourth resistor, wherein the first resistor has one terminal connected to a first high power potential and the other terminal connected to a first input terminal of the operational amplifier, wherein the second resistor has one terminal connected to the first input terminal of the operational amplifier and the other terminal connected to an output terminal of the operational amplifier, wherein the third resistor has one terminal connected to a second high power potential and the other terminal connected to a second input terminal of the operational amplifier, wherein the fourth resistor has one terminal connected to the second input terminal of the operational amplifier and the other terminal connected to a low power potential, wherein a potential of the other terminal of the second resistor is supplied as a lower power potential of a buffer, and wherein the second high power potential is supplied as a higher power potential of the buffer.

10. The light emitting device according to claim 9, wherein the light emitting element is an EL element.

11. The light emitting device according to claim 9, wherein the light emitting device is provided over a semiconductor substrate.

12. The light emitting device according to claim 9, wherein the light emitting device is provided over a glass substrate.

13. The light emitting device according to claim 9, wherein the light emitting device is provided over a flexible substrate.

14. The light emitting device according to claim 9, wherein the light emitting device is provided over an SOI substrate.

15. The light emitting device according to claim 9, wherein the light emitting device includes a thin film transistor.

16. An IC card, an IC tag, an RFID, a transponder, paper money, securities, a passport, an electronic device, a bag, clothes each of which includes the light emitting device according to claim 9.

17. A light emitting device comprising:

a bipolar transistor having a base terminal, and a collector terminal and an emitter terminal;

a circuit having an operational amplifier, a first resistor, a second resistor, a third resistor, a fourth resistor; and a driver circuit having a buffer, wherein the operational amplifier has an output terminal, a first input terminal and a second input terminal, wherein the base terminal is connected to the output terminal of the operational amplifier and the collector terminal is connected to a low power potential, wherein the first resistor has one terminal connected to a first high power potential and the other terminal connected to the first input terminal of the operational amplifier, wherein the second resistor has one terminal connected to the first input terminal of the operational amplifier and the other terminal connected to the emitter terminal of the bipolar transistor, wherein the third resistor has one terminal connected to a second high power potential and the other terminal connected to the second input terminal of the operational amplifier, wherein the fourth resistor has one terminal connected to the second input terminal of the operational amplifier and the other terminal connected to a low power potential, wherein a potential from the emitter terminal of the bipolar transistor and the other terminal of the second resistor is equal to a low power potential of the buffer of the driver circuit, and wherein the second high power potential is equal to as a high power potential of the buffer.

18. The light emitting device according to claim 17, wherein the light emitting device is provided over a semiconductor substrate.

19. The light emitting device according to claim 17, wherein the light emitting device is provided over a glass substrate.

20. The light emitting device according to claim 17, wherein the light emitting device is provided over a flexible substrate.

21. The light emitting device according to claim 17, wherein the light emitting device is provided over an SOI substrate.

22. The light emitting device according to claim 17, wherein the light emitting device includes a thin film transistor.

23. An IC card, an IC tag, an RFID, a transponder, paper money, securities, a passport, an electronic device, a bag, clothes each of which includes the light emitting device according to claim 17.

24. A light emitting device comprising:

a circuit having an operational amplifier, a first resistor, a second resistor, a third resistor, a fourth resistor; and a driver circuit having a buffer, wherein the operational amplifier has an output terminal, a first input terminal and a second input terminal, wherein the first resistor has one terminal connected to a first high power potential and the other terminal connected to the first input terminal of the operational amplifier, wherein the second resistor has one terminal connected to the first input terminal of the operational amplifier and the other terminal connected to the output terminal of the operational amplifier, wherein the third resistor has one terminal connected to a second high power potential and the other terminal connected to the second input terminal of the operational amplifier, wherein the fourth resistor has one terminal connected to the second input terminal of the operational amplifier and the other terminal connected to a low power potential, wherein a potential of the other terminal of the second resistor is equal to a lower power potential of a buffer, and wherein the second high power potential is equal to as a higher power potential of the buffer.

25. The light emitting device according to claim 24, wherein the light emitting device is provided over a semiconductor substrate.

26. The light emitting device according to claim 24, wherein the light emitting device is provided over a glass substrate.

27. The light emitting device according to claim 24, wherein the light emitting device is provided over a flexible substrate.

28. The light emitting device according to claim 24, wherein the light emitting device is provided over an SOI substrate.

29. The light emitting device according to claim 24, wherein the light emitting device includes a thin film transistor.

30. An IC card, an IC tag, an RFID, a transponder, paper money, securities, a passport, an electronic device, a bag, clothes each of which includes the light emitting device according to claim 24.

31. A driving method of a light emitting device comprising a buffer, the driving method comprising the steps of:

supplying a high power potential to the buffer; and supplying a low power potential to the buffer, wherein, when the high power potential rises, the low power potential rises by following the rising of the high power potential.

* * * * *